US005305679A

United States Patent [19]

Begneu

[11] Patent Number: 5,305,679

[45] Date of Patent: Apr. 26, 1994

[54] CYLINDER MORTAR

[75] Inventor: Michel Begneu, Bourges, France

[73] Assignee: Giat Industries, Versailles, France

[21] Appl. No.: 941,148

[22] PCT Filed: Feb. 10, 1992

[86] PCT No.: PCT/FR92/00114

§ 371 Date: Dec. 7, 1992

§ 102(e) Date: Dec. 7, 1992

[87] PCT Pub. No.: WO92/17746

PCT Pub. Date: Oct. 15, 1992

[30] Foreign Application Priority Data

Apr. 4, 1991 [FR] France ..... 91 04117

[51] Int. Cl.[5] ..... F41A 3/74; F41A 3/76; F41A 9/77

[52] U.S. Cl. ..... 89/26

[58] Field of Search ..... 89/26, 1.35

[56] References Cited

U.S. PATENT DOCUMENTS

| | | | |
|---|---|---|---|
| 3,403,596 | 10/1968 | Bartels | 89/26 |
| 3,420,139 | 1/1969 | Bartels | 89/26 |
| 3,783,737 | 1/1974 | Ashley | 89/26 |
| 4,709,616 | 12/1987 | Bartoiles | 89/26 |
| 5,054,366 | 10/1991 | Bartolles | 89/26 |
| 5,147,971 | 9/1992 | Bartolles | 89/26 |

FOREIGN PATENT DOCUMENTS

| | | |
|---|---|---|
| 0036811 | 9/1981 | European Pat. Off. . |
| 0234650 | 9/1987 | European Pat. Off. . |
| 1487089 | 6/1967 | France . |
| 687826 | 2/1953 | United Kingdom . |

*Primary Examiner*—David H. Brown
*Attorney, Agent, or Firm*—Oliff & Berridge

[57] ABSTRACT

A rapid fire mortar including an ammunition cylinder, each of whose chambers is provided at its rear end with a metal seal, of which the bottom forms a support for a round of ammunition. The seal is slidably mounted in the chamber to compensate for variations in the dimensions of the chambers and has walls which are elastically deformable by the gas pressure when firing in order to ensure gas-tightness between the chamber and a firing plate.

16 Claims, 2 Drawing Sheets

CYLINDER MORTAR

BACKGROUND OF THE INVENTION

The invention concerns a cylinder mortar of the type in which a gun barrel is associated with an ammunition cylinder mounted to rotate about an axis parallel to the axis of the barrel. The mortar includes a plurality of cylindrical chambers for receiving rounds of ammunition, open at their front and rear ends and each movable by rotation of the cylinder to a firing position aligned with the barrel. The rear end of the mortar then being supported on a firing plate including means for firing the ammunition.

Mortars of this type are generally fitted to armored vehicles and allow a relatively high rate of fire, thanks to the cylinders whose chambers can easily be reloaded with ammunition during firing and which also enable rapid burst firing when all the chambers of a cylinder have been preloaded.

However, the rotation of the cylinder which enables the chambers to be brought into firing position in turn, i.e. into alignment with the barrel and supported on the firing plate with the means for firing the ammunition, requires high dimensional accuracy of the parts in question and use of more or less complex means to ensure gas tightness during firing, while allowing rapid rotation of the cylinder and loading the chambers through their front ends.

SUMMARY OF THE INVENTION

An object of the invention is to overcome these problems using means of simple structure.

To this end, the invention provides a cylinder mortar of the type defined above which is characterized in that each chamber includes at its rear end elastically deformable means forming an abutment for supporting and positioning the rounds of ammunition inserted in the chamber through the front end thereof and further ensuring gas tightness on firing, relative to the chamber and to the firing plate.

The elastic deformation of the aforesaid means caused by the propellant gas pressure during firing makes complete sealing between the chamber and the firing plate possible. Moreover the weight of the round loaded into the chamber enables these means to be elastically supported with gentle pre-stressing on the firing plate when the chamber is brought into firing position.

In a preferred embodiment of the invention, these means are constituted by a metal seal of generally cylindrical shape, open at the front and having an annular bottom wall at the rear end with a central aperture, this seal being mounted in a bore in the rear end of the chamber and retained in this bore by means such as a screw retainer.

This cylinder seal is slidably mounted, without radial play, in the bore of the chamber and has a ground cylindrical outer surface with a diameter equal to the diameter of the bore of the chamber.

The sliding fit of the seal in the chamber, without play, compensates for the variations in the manufacturing dimensions of the chambers, without impairing sealing. The grinding of the contacting cylindrical surfaces of the seal and the chamber further avoids metal-metal inclusions when firing, which would jam the seal in the chamber and prevent its normal operation.

According to another feature of the invention, the inner surface of the seal is cylindrical with a circular cross-section in the vicinity of the bottom wall, with a diameter ensuring that ammunition is centered, and is flared over its front part, the wall thickness of the seal tapering towards its front end.

This inner flared surface is intended to facilitate loading and positioning of a round of ammunition in the chamber and also to facilitate the elastic deformation of the corresponding part of the seal. The corresponding part is supported by the bore of the chamber to ensure sealing under the action of the gas pressure during firing.

According to another feature of the invention, the outer surface of the bottom wall of the seal is slightly coned, its smaller base forming the aforesaid central aperture and protruding from the bottom of the seal.

The inner surface of the bottom wall of the seal comprises an annular part lying in a plane perpendicular to the axis of the seal and joined to the inner cylindrical surface of the seal to form a support face for the bottom of the round of ammunition, and a coned part extending up to the central aperture of the bottom wall, the thickness of this wall tapering towards the axis.

Thus, the bottom of the seal is capable of withstanding the shock of ammunition being loaded through the front end of the chamber and falling under gravity inside the chamber, and is also capable of deforming elastically for application under pressure to the firing plate and to ensure gas-tightness during firing.

BRIEF DESCRIPTION OF THE DRAWINGS

The invention will be better understood and other features, details and advantages thereof will appear more clearly from the following description, given by way of example with reference to the accompanying drawings, in which.

DETAILED DESCRIPTION OF PREFERRED EMBODIMENTS

The seal of the invention is intended for use in particular in rapid fire 81 mm mortars, such as have been developed for mounting on light armored vehicles. Such a mortar is well known, and its general structure is thus not shown.

Figure 1:
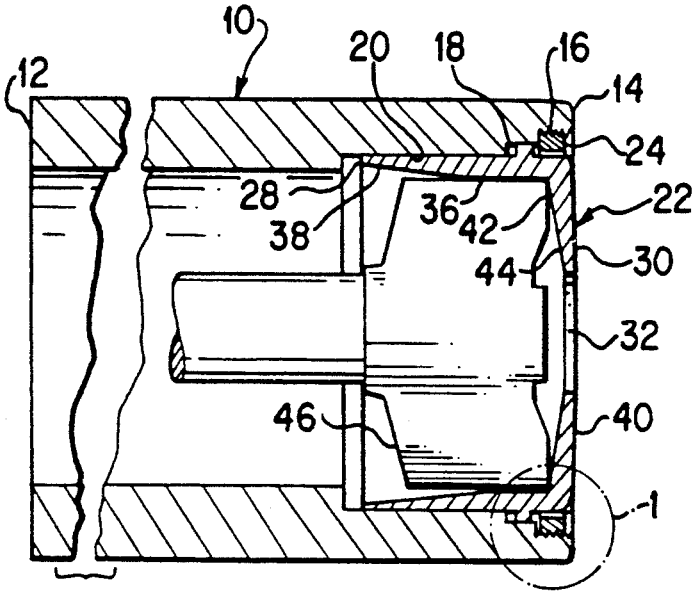
FIG. 1 is a schematic view in axial section of a chamber including a metal seal in accordance with the invention.
Figure 1A:
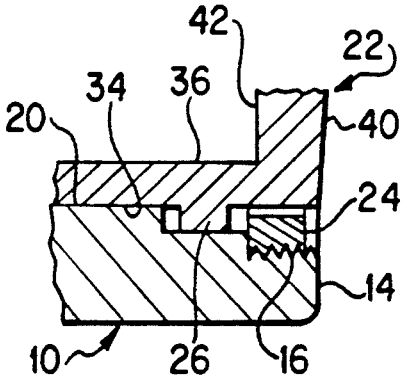
FIG. 1A is a view to a larger scale of the circled detail I of FIG. 1.

The cylinder of the mortar comprises five chambers, such as that shown schematically in FIG. 1 and designated by the reference numeral 10, these being of generally cylindrical shape and of circular cross-section, with open front and rear ends 12 and 14.

In the embodiment shown in the drawings, the rear end 14 of each chamber 10 comprises three bores 16, 18 and 20 in succession, with progressively decreasing diameters, which are used to receive and retain a metal seal 22 of the invention.

The bore 16 of greatest diameter in the rear part of the chamber 10 has an internally threaded surface and receives a screw retainer 24 for the seal 22 in the chamber.

The short second bore 18 is adapted to receive an annular rib 26 projecting from the outer cylindrical surface of the seal 22, while the third bore 20 forms the seat proper for the seal 22.

The seal 22 is made from spring steel and is of generally cylindrical shape, with an open front end 28 and a rear end comprising an annular bottom wall 30 with a central aperture 32. The outer cylindrical surface 34 of the seal has a diameter equal to that of the bore 20 of the chamber 10 and is ground, as is the surface of the bore, to allow the seal to slide without play in the bore 20.

The corresponding inner surface of the seal comprises a cylindrical part 36 of circular cross-section, joined to the bottom wall 30 of the seal and having a diameter equal to the inner diameter of the chamber 10 past the bore 20, and also comprising a flared part 38 continuing from the cylindrical part 36 up to the front end 28 of the seal and flaring towards this end, so that the thickness of the wall of the seal tapers towards its front end. The vertex angle of this flared part is slight, and is 8° in the preferred embodiment of the invention.

The bottom wall 30 of the seal has a coned outer surface 40 with a very flat vertex angle (179.26° in the preferred embodiment of the invention) and facing outwards so that the edge of the central aperture 32 projects slightly outwards. The inner surface of this bottom wall 30 comprises an annular part 42 perpendicular to the axis of symmetry of the seal, continuing to the central aperture 32 via a coned part 44 having a vertex angle that is smaller than that of the outer coned surface 40 (being 172° for example in the preferred embodiment of the invention), so that the thickness of the bottom wall 30 reduces progressively in the direction of the axis of symmetry of the seal.

As indicated above, the seal also has an annular rib 26 projecting from its outer surface, near to its rear end.

In order to mount the seal 22 in the chamber, it suffices to introduce the seal into the rear end of the chamber, then to screw the screw retainer 24 in place until it abuts the bottom of the first bore 16. The sliding range of the seal 22 in the bore 20 of the chamber is limited by the annular rib 26 which abuts either the screw retainer 24 or the bottom of the second bore 18 at the rear of the chamber. When the seal 22 is supported with its rib 26 on the screw retainer 24, the outer surface of the bottom wall 30 of the seal 22 projects slightly outwards, relative to the rear end 14 of the chamber 10.

Operation is as follows:

In the loading position, which corresponds to that shown in FIG. 1, the chamber is obliquely inclined relative to the horizontal and it is loaded with a conventional round of mortar ammunition, of which only the rear end with the fins 46 is shown in FIG. 1. The ammunition is introduced through the front end of the chamber 10 and falls under gravity inside the chamber onto the metal seal 22. Centering of the ammunition is ensured by the cylindrical part 36 of the inner surface of the seal 22 and support by the annular surface 42 of the bottom 30. Under the action of the weight of the ammunition, which is on the order of 4 kg for an 81 mm mortar, the seal 22 is supported with its annular rib 26 on the screw retainer 24.

Figure 2:
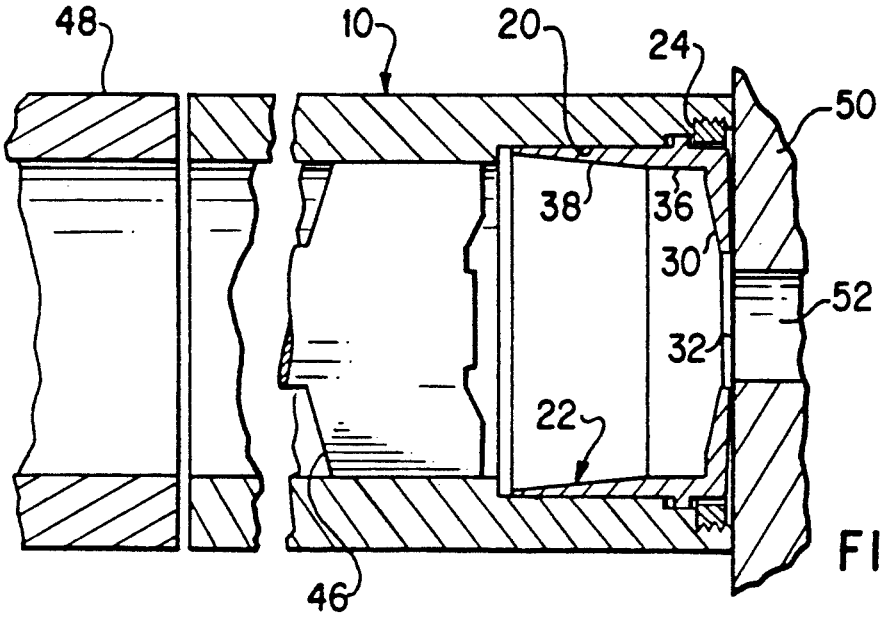
FIG. 2 is a view like FIG. 1 but showing the chamber in firing position.
Figure 3:
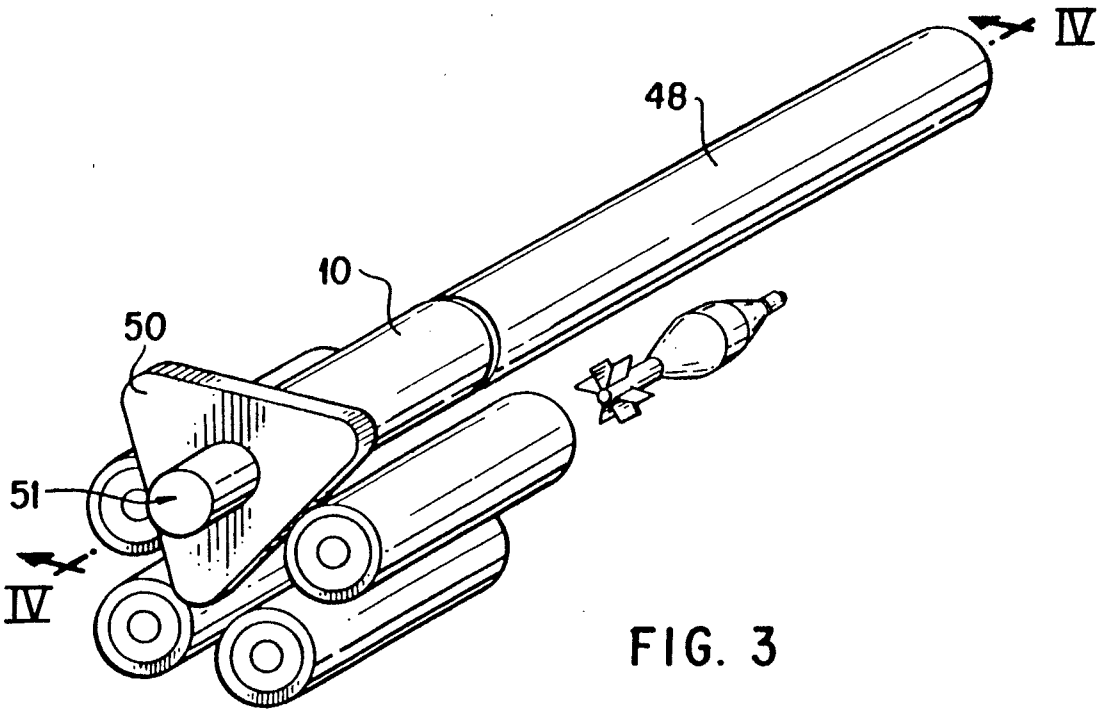
FIG. 3 is a perspective view of the cylinder mortar.
Figure 4:
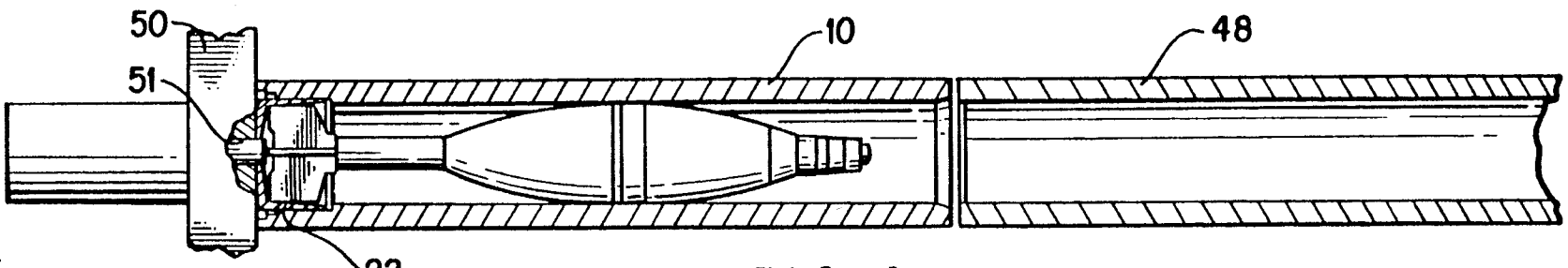
FIG. 4 is a cross section along line IV—IV in FIG. 3.

By rotating the cylinder, the chamber 10 containing the ammunition is brought into the firing position, shown schematically in FIG. 2, in which it is aligned with the barrel 48 of the mortar and is supported at its rear end on a firing plate 50 comprising means, 51, such as a firing pin, in a bore 52 for firing the ammunition. The sliding fit of the seal 22 in the chamber 10 allows automatic adjustment of the position of the seal 22, whose bottom wall 30 is elastically supported on the firing plate 50, under the action of the weight of the ammunition, the central aperture 32 of this bottom wall being aligned with the bore 52 of the firing plate 50 and having a diameter greater than that of the bore. Sealing between the chamber and the firing plate 50 is thus ensured as soon as the chamber 10 is in firing position. At the start of firing, a relatively high pressure develops very rapidly inside the chamber 10, being from 100 bar to 600 bar, depending on the propellant charge of the ammunition, and has the effect of applying the cylindrical wall of the seal 22 hard against the wall of the bore 20 of the chamber and also the bottom wall 30 against the firing plate 50, so ensuring sealing in relation to the propellant gas. By virtue of the structure described above, the deformation of this wall of the seal remains in the elastic range and the seal recovers its initial shape after the start of firing, as the pressure falls inside the chamber 10.

As appears clearly from the preceding, the seal of the invention ensures a very good gas seal on firing the ammunition and enables the variations in the dimensions of the chamber to be compensated, through its elastic pre-stressing on the firing plate.

I claim:

1. A cylinder mortar of the type in which a gun barrel is associated with an ammunition cylinder mounted to rotate about an axis parallel to the axis of the barrel and comprising a plurality of cylindrical chambers for receiving rounds of ammunition, said chambers being open at front and rear ends and movable by rotation of the cylinder to a firing position aligned with the barrel, a rear end of said chamber being supported on a firing plate, said cylinder mortar further comprising means for firing the ammunition, each of said chambers comprising:

elastically deformable means for forming an abutment for supporting the rounds of ammunition inserted in the chamber through the front end thereof and further for ensuring gas tightness on firing, relative to the chamber and to the firing plate, the elastically deformable means comprising a metal seal of generally cylindrical shape, said seal being open at a front end and having an annular bottom wall at a rear end, said seal comprising a central aperture, wherein said seal is mounted in a bore in the rear end of the chamber and is retained in said bore by a retaining means, said elastically deformable means further comprising means for positioning the rounds of ammunition, said positioning means comprising an inner surface of the seal, wherein a diameter of said inner surface is substantially equal to a diameter of the ammunition.

2. A mortar according to claim 1, wherein the metal seal is slidably mounted, without radial play, in the bore of the chamber and has a cylindrical outer surface with a diameter equal to the diameter of the bore of the chamber.

3. A mortar according to claim 2, wherein said cylindrical outer surface of the seal comprises an annular rib proximate said rear end, the rib being received in a short bore of the chamber and cooperating with a bottom of said short bore and with said retaining means to limit the sliding of the seal relative to the chamber.

4. A mortar according to claim 1, wherein an outer surface of the bottom wall of the seal is slightly coned, its smaller base forming said central aperture and protruding from the rear end of the seal.

5. A mortar according to claim 4, wherein the vertex angle of said coned outer surface is about 179.26°.

6. A mortar according to claim 1, wherein said retaining means is a screw retainer.

7. A mortar according to claim 6, wherein said screw retainer threadedly engages a threaded bore in said chamber.

8. A mortar according to claim 1, wherein an inner surface of the seal is cylindrical and has a circular cross-section proximate to the bottom wall, a diameter of said inner surface being substantially equal to a diameter of the ammunition for ensuring that the round of ammunition is centered, said inner surface being flared over its front part, a wall thickness of the seal tapering towards its front end.

9. A mortar according to claim 8, wherein the vertex angle of said flared inner surface of the seal is about 8°.

10. A mortar according to claim 8, wherein an inner surface of the bottom wall of the seal comprises an annular part disposed in a plane perpendicular to the axis of the seal and joined to the inner surface of the seal, said annular part forming a support face for the round of ammunition, the inner surface of the bottom wall of the seal further comprising a coned part extending to the central aperture of the bottom wall, the thickness of said wall tapering toward the axis of the seal.

11. A mortar according to claim 10, wherein vertex angle of the coned part of the inner surface of the bottom of the chamber is about 172°.

12. A cylinder mortar of the type in which a gun barrel is associated with an ammunition cylinder mounted to rotate about an axis parallel to the axis of the barrel and comprising a plurality of cylindrical chambers for receiving rounds of ammunition, said chambers being open at front and rear ends and movable by rotation of the cylinder to a firing position aligned with the barrel, a rear end of said chamber being supported on a firing plate, said cylinder mortar further comprising means for firing the ammunition, each of said chambers comprising:

a metal seal of generally cylindrical shape, said seal being open at a front end and having an annular bottom wall at a rear end, said seal comprising a central aperture, wherein said seal is mounted in a bore in the rear end of the chamber and is retained in said bore by a retaining means, wherein an inner surface of the seal is cylindrical and has a circular cross-section proximate to the bottom wall, a diameter of said inner surface being substantially equal to a diameter of the ammunition for ensuring that the round of ammunition is centered, said inner surface being flared over its front part, a wall thickness of the seal tapering towards its front end.

13. A mortar according to claim 12, wherein the vertex angle of said flared inner surface of the seal is about 8°.

14. A mortar according to claim 12, wherein an inner surface of the bottom wall of the seal comprises an annular part disposed in a plane perpendicular to the axis of the seal and joined to the inner surface of the seal, said annular part forming a support face for the round of ammunition, the inner surface of the bottom wall of the seal further comprising a coned part extending to the central aperture of the bottom wall, the thickness of said wall tapering toward the axis of the seal.

15. A mortar according to claim 14, wherein the vertex angle of the coned part of the inner surface of the bottom of the chamber is about 172°.

16. A cylinder mortar of the type in which a gun barrel is associated with an ammunition cylinder mounted to rotate about an axis parallel to the axis of the barrel and comprising a plurality of cylindrical chambers for receiving rounds of ammunition, said chambers being open at front and rear ends and movable by rotation of the cylinder to a firing position aligned with the barrel, a rear end of said chamber being supported on a firing plate, said cylinder mortar further comprising means for firing the ammunition, each of said chambers comprising:

a metal seal of generally cylindrical shape, said seal being open at a front end and having an annular bottom wall at a rear end, said seal comprising a central aperture, wherein said seal is mounted in a bore in the rear end of the chamber and is retained in said bore by a retaining means, wherein the metal seal is slidably mounted, without radial play, in the bore of the chamber and has a cylindrical outer surface with a diameter equal to the diameter of the bore of the chamber, wherein said cylindrical outer surface of the seal comprises an annular rib proximate said rear end, the rib being received in a short bore of the chamber and cooperating with a bottom of said short bore and with said retaining means to limit the sliding of the seal relative to the chamber.

* * * * *